United States Patent [19]

Denley et al.

[11] Patent Number: 4,479,040

[45] Date of Patent: Oct. 23, 1984

[54] TACTILE FEEL SWITCH WITH POSITIVE SWITCH ACTUATION

[75] Inventors: Ronald S. Denley, Woodstock; Anthony J. Van Zeeland, Crystal Lake, both of Ill.

[73] Assignee: Oak Industries Inc., Rancho Bernardo, Calif.

[21] Appl. No.: 473,032

[22] Filed: Mar. 7, 1983

[51] Int. Cl.[3] ..... H01H 15/18

[52] U.S. Cl. ..... 200/77; 200/153 V; 200/159 B

[58] Field of Search ..... 200/340, 153 V, 77, 200/68.1, 159 B, 153 B, 153 T, 160, 335

[56] References Cited

U.S. PATENT DOCUMENTS 4,129,758 12/1978 Gilano et al. ..... 200/340

4,136,569 1/1979 Hollweck ..... 200/340

4,417,115 11/1983 Desmarais et al. ..... 200/159 B

*Primary Examiner*—John W. Shepperd

*Assistant Examiner*—Renee S. Kidorf

*Attorney, Agent, or Firm*—Kinzer, Plyer, Dorn & McEachran

[57] ABSTRACT

A switch for use in keyboards and the like has a housing mounted on a baseplate, with a set of electrical contacts associated with the housing. There is a reciprocative plunger mounted in the housing. An actuator is operatively connected to the electrical contacts for closing them in response to movement of the plunger. A first spring is located between the plunger and the actuator biasing these components apart. A reciprocative coupler is mounted in the housing, and is engageable with the plunger during a first portion of the plunger stroke. The coupler includes a blocking tang which engages the actuator during the first portion of the plunger stroke to prevent movement of the actuator. A second spring is located between the coupler and the housing to bias the coupler upwardly, this force being also transferred to the plunger when the coupler and plunger are engaged. After a predetermined amount of plunger travel, a trip mechanism separates the coupler from the plunger with the resulting decrease in resistance to the plunger stroke providing a tactile feedback to the operator. Simultaneously, the blocking tang disengages the actuator so the first spring is able to cause the actuator to close the switch.

8 Claims, 22 Drawing Figures

Fig. 3.
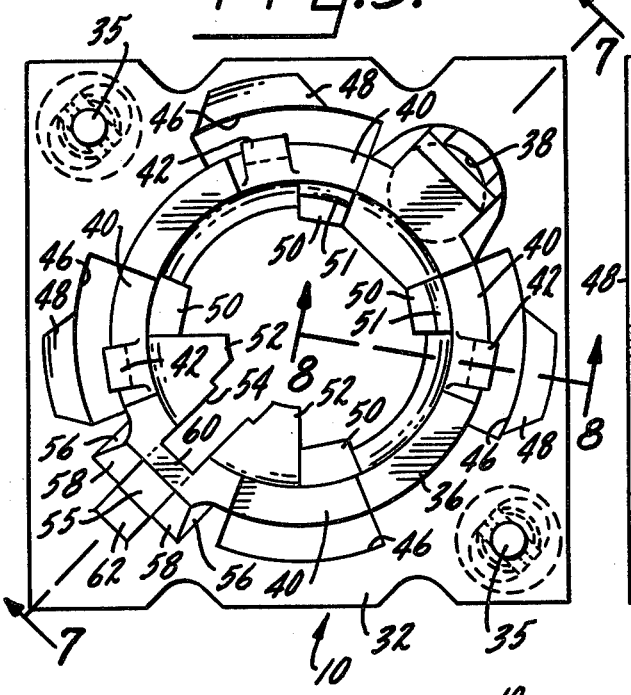
Fig. 4.
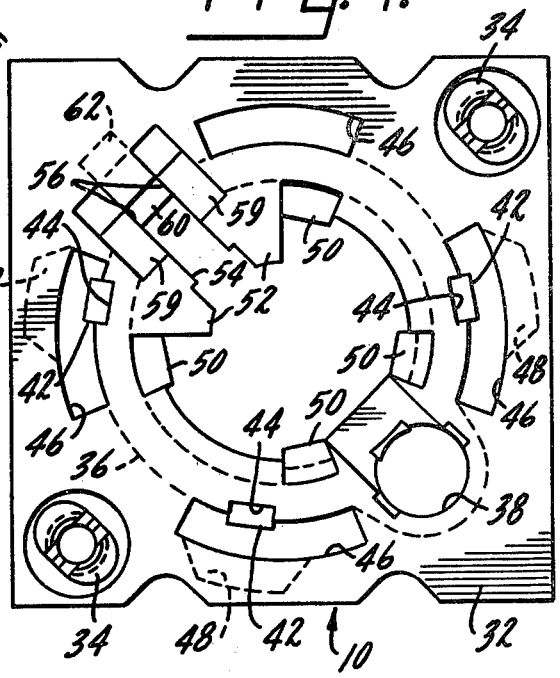
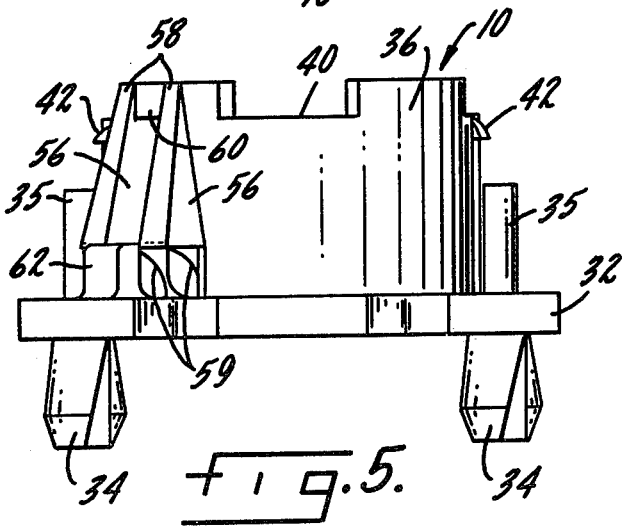
Fig. 5.
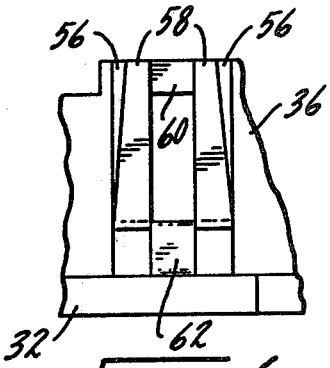
Fig. 6.
Fig. 7.
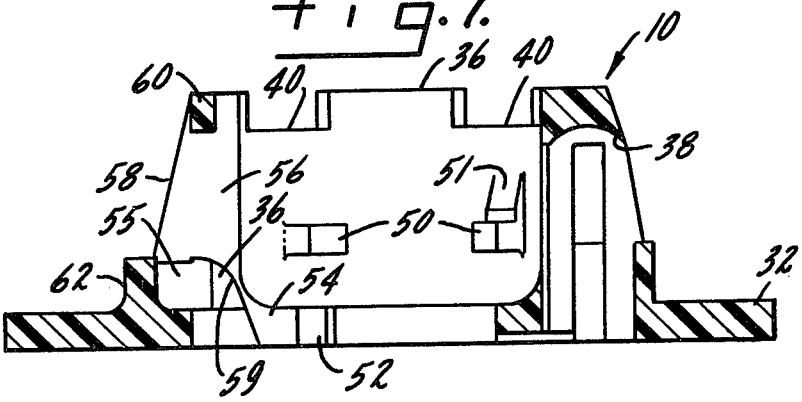
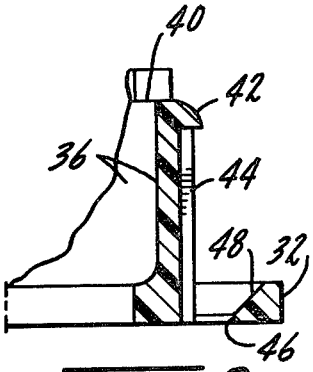
Fig. 8.

Fig. 9.
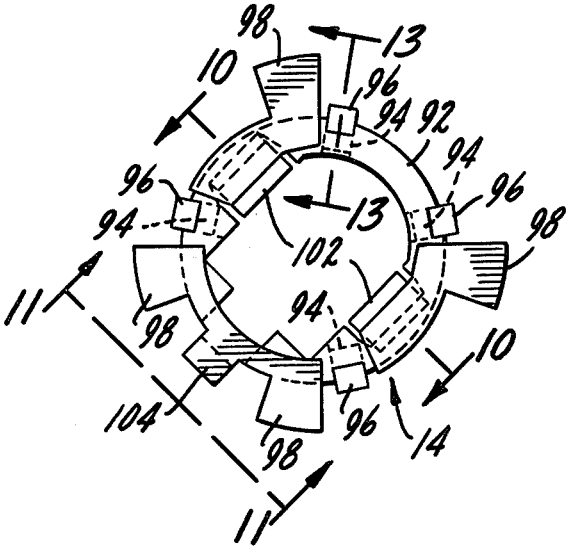
Fig. 10.
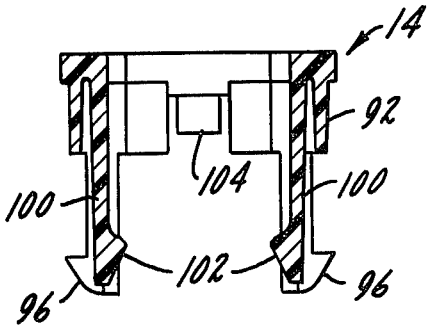
Fig. 11.
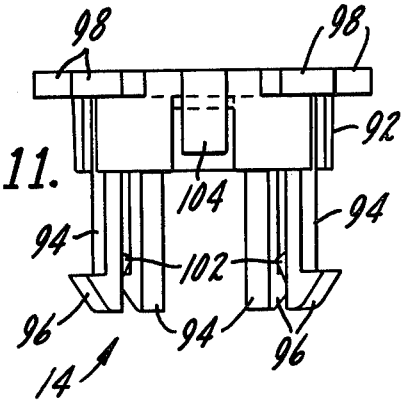
Fig. 12.
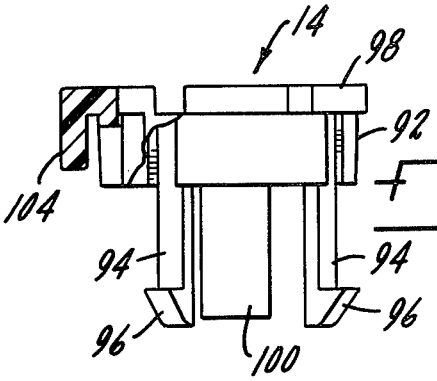
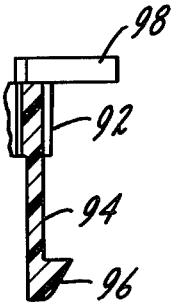
Fig. 13.
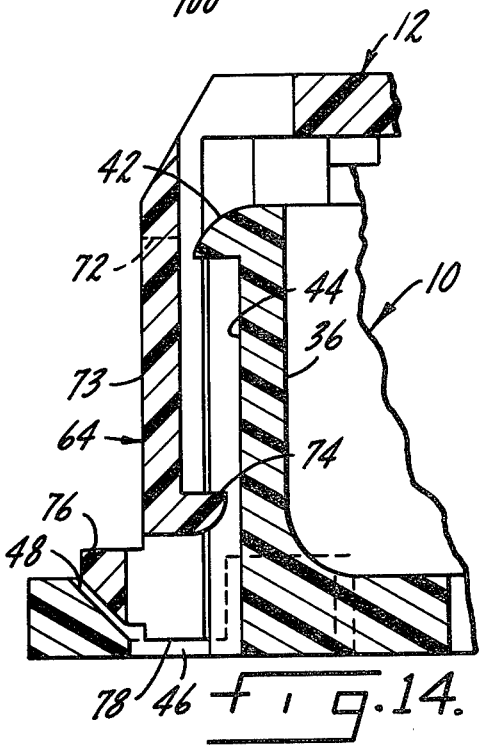
Fig. 14.

Fig. 15.
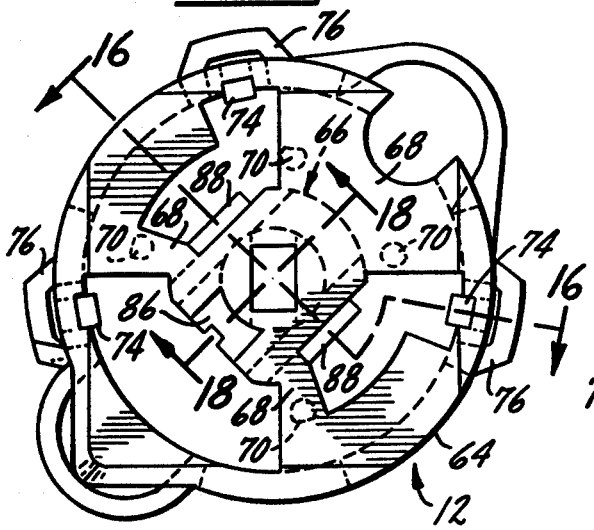
Fig. 17.
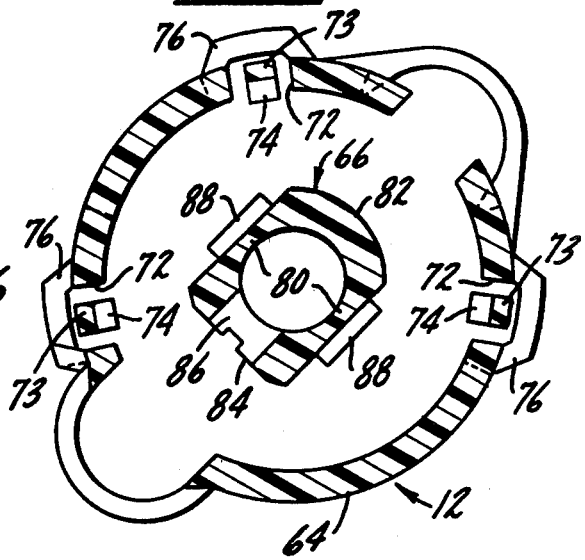
Fig. 16.
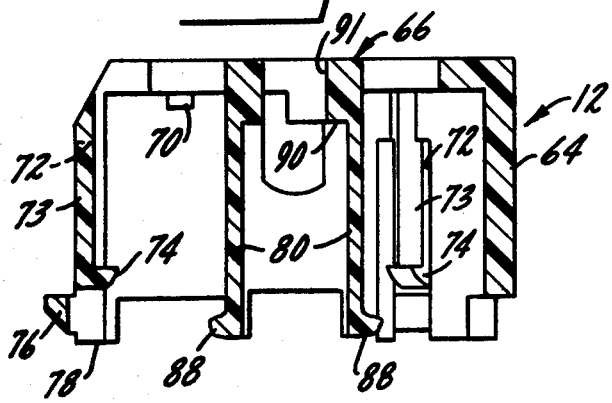
Fig. 18.
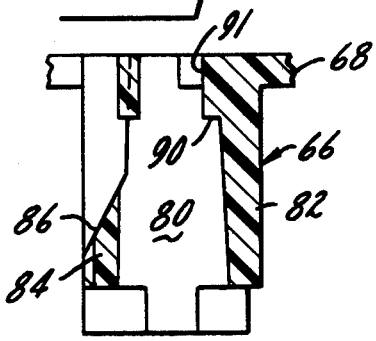
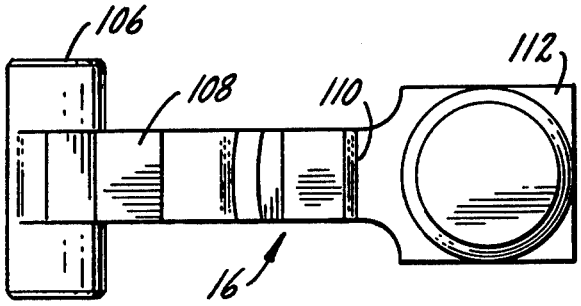
Fig. 20.
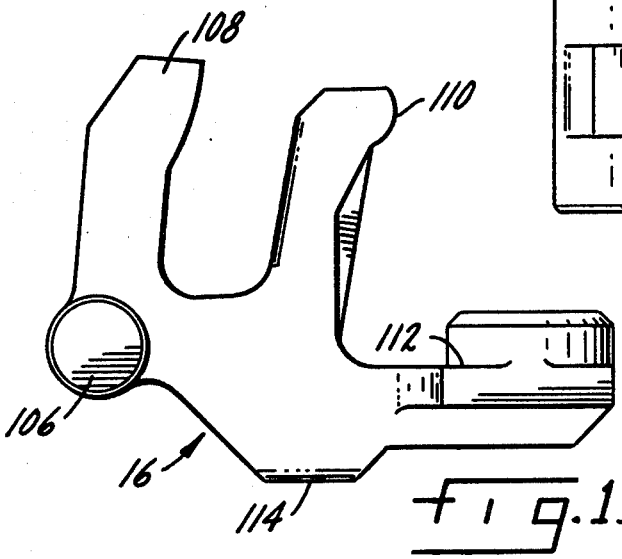
Fig. 19.

TACTILE FEEL SWITCH WITH POSITIVE SWITCH ACTUATION

SUMMARY OF THE INVENTION

This invention relates to switches or keys for use in keyboards. The switches are particularly adapted for actuating the electrical contacts of a membrane switch panel which is mounted on a baseplate.

A primary object of the present invention is a switch which provides tactile feedback to the user so the user can be assured that actuation has occurred.

Another object of this invention is a switch providing positive, snap-action actuation of the electrical contact.

Another object is a switch of the type described wherein the tactile feedback and actuation occur simultaneously.

Another object is a switch having a cushioned plunger overtravel stop.

Another object is a switch wherein contact bounce is minimized due to the damping provided by the actuating mechanism.

Yet another object of this invention is a switch having provision for lighting the key cap.

Still another object is a switch which can be machine assembled.

Other objects will appear from time to time in the following specification, drawings and claims.

BRIEF DESCRIPTION OF THE DRAWINGS

FIG. 3 is a plan view of the switch housing.

FIG. 4 is a bottom view of the switch housing.

FIG. 5 is a front elevation view of the housing.

FIG. 6 is an elevation view of the actuator mounting chamber of the housing.

FIG. 7 is a section through the housing, taken along line 7—7 of FIG. 3.

FIG. 8 is a section of the housing taken along line 8—8 of FIG. 3.

FIG. 9 is a plan view of the coupler.

FIG. 10 is a section through the coupler, taken generally along line 10—10 of FIG. 9.

FIG. 11 is an elevation view of the coupler, looking in the direction of line 11—11 of FIG. 9.

FIG. 12 is an elevation view of the coupler, rotated 90° from the view of FIG. 11.

FIG. 13 is a section of the coupler taken along line 13—13 of FIG. 9.

FIG. 14 is a section through a typical plunger-housing interlock.

FIG. 15 is a plan view of the plunger.

FIG. 16 is a section taken generally along line 16—16 of FIG. 15.

FIG. 17 is a section taken generally along line 17—17 of FIG. 15.

FIG. 18 is a section taken generally along line 18—18 of FIG. 15.

FIG. 19 is a side elevation view of the actuator, on an enlarged scale.

FIG. 20 is a plan view of the actuator.

DESCRIPTION OF A PREFERRED EMBODIMENT

Figure 1:
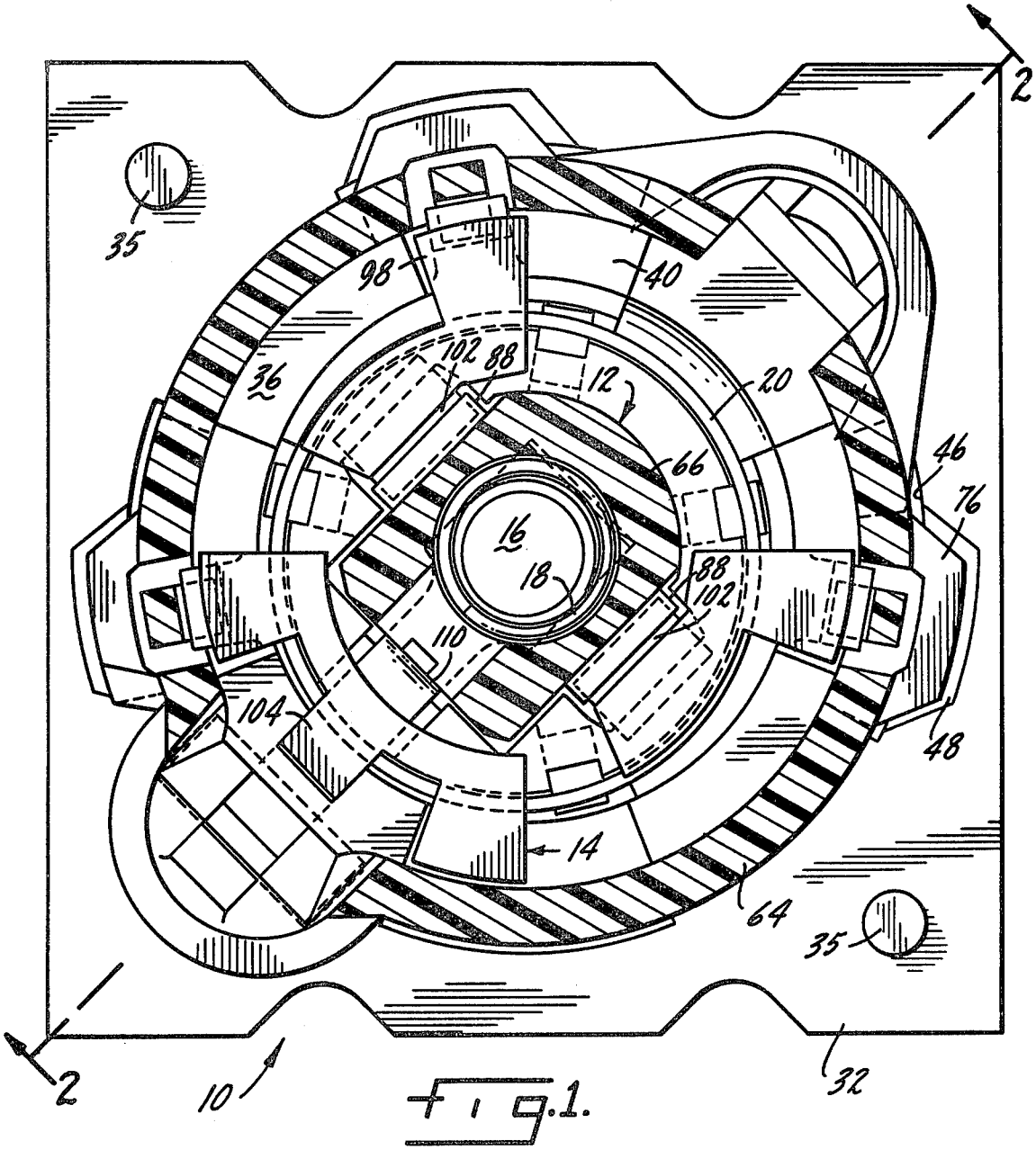
FIG. 1 is a plan view of a switch assembly, with the key cap and portions of the plunger removed to show the underlying parts.
Figure 2:
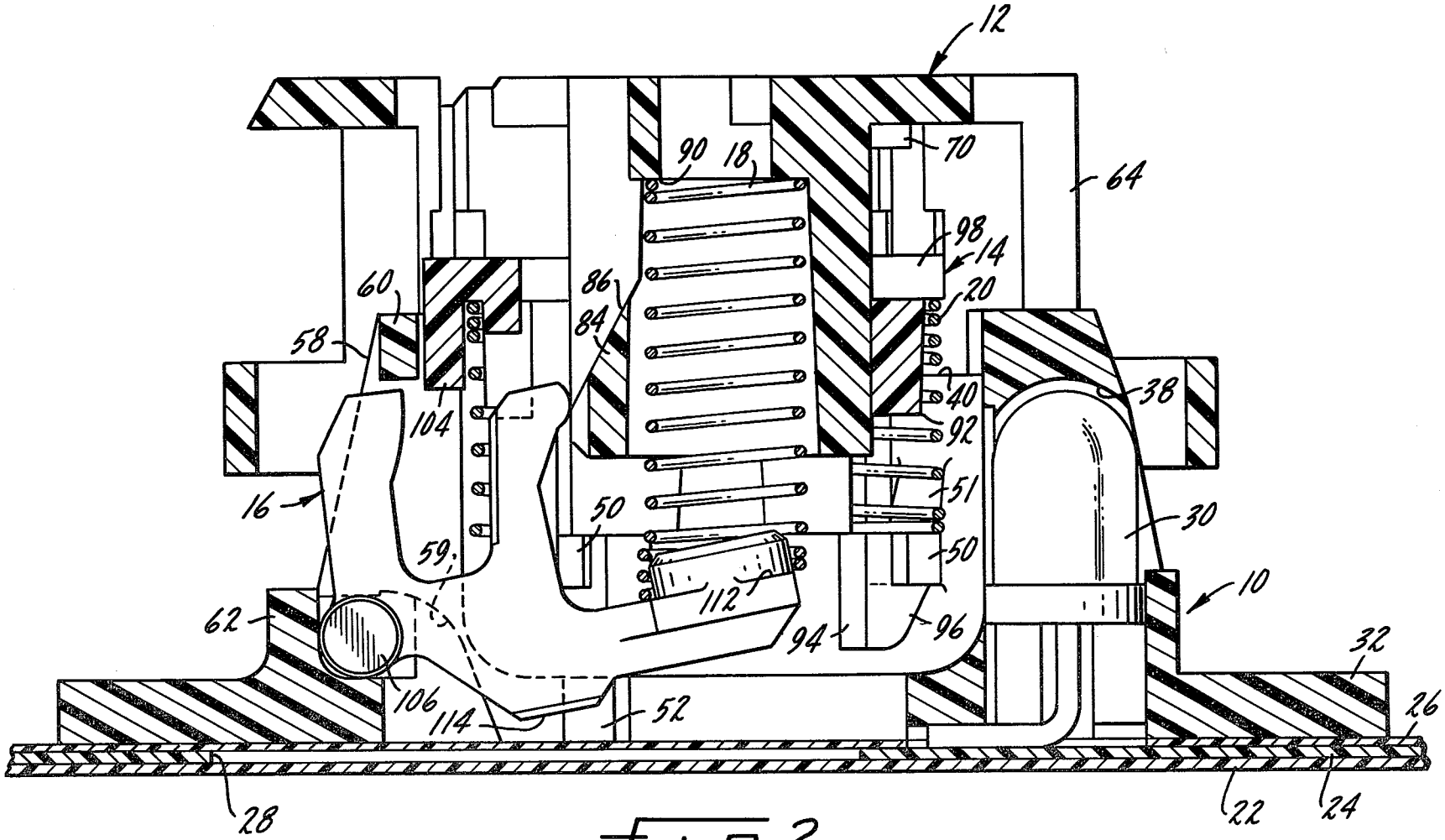
FIG. 2 is a section of a switch assembly, taken generally along line 2--2 of FIG. 1.

Considering first FIGS. 1 and 2, the switch includes a housing indicated generally at 10 in which are mounted a reciprocative plunger 12 and a coupler 14. The plunger may carry a key cap (not shown) of a conventional size for keyboard operations. Pivotally mounted in the housing and in position to be in cooperative contact with plunger 12 and coupler 14 is an actuator 16 which will be described in more detail below. A first, inner spring 18 is located between the actuator 16 and the plunger 12, biasing these elements apart. A second outer spring 20 is located between the housing 10 and the coupler 14, urging the coupler upwardly.

The switch housing 10 is seated upon a membrane switch array which may comprise a substrate 22, an intermediate spacer 24 and a membrane 26. Conventionally, the membrane and substrate will have electrical contacts thereon which are positioned beneath actuator 16. An opening 28 is provided in the spacer beneath the actuator so that movement of the plunger 12 and thus actuator 16 can effect a switch closure between the membrane and substrate. The substrate 22 may be rigid or it may be made of a flexible material as is the membrane. In the latter case the membrane switch array would be mounted on a rigid baseplate with fastening means on the housing extending through both the membrane switch array and the baseplate.

The housing 10 has a space for a light source, such as a light emitting diode 30. The leads of the LED connect to the membrane switch spacer 24 through an opening in the membrane as described and claimed in U.S. Pat. No. 4,414,452, issued Nov. 8, 1983 and assigned to the present assignee. Or other arrangements could be made for providing electrical connection to the LED.

FIGS. 3-8 illustrate various details of the housing 10. The housing is made of a suitable plastic material such as thermoplastic polyester. It has a base 32 which includes fastening means 34 at opposite corners. The fastening means may be expandable rivets including pegs 35 as shown or they could be legs for heat staking and the like. A cylindrical wall 36 having a central opening extends upwardly from the center of the base 32. The wall 36 has a cavity 38 for receiving an LED as described above. The portion of the wall above the cavity 38 may constitute a lens for directing light from the LED. In this case an optically clear thermo-plastic, such as Polycarbonate, would be used for the housing. The top surface of the wall 36 has a plurality of cutout portions which form seats 40. Extending from three of these seats 40 are hooks 42 which protrude slightly from the outer diameter of the wall 36. Underneath each hook 42 is a vertical slot 44 which is formed by a slight indentation in the outer surface of the wall 36. These slots extend the entire height of the wall and communicate with a plurality of arcuate openings 46 formed in the base 32 of the housing. The openings 46 extend all the way through the base. Three of the openings 46 merge with an angled surface 48 which is formed in the base. There are four inwardly projecting ledges 50 formed on the interior surface of the wall 36. Two of the ledges have an angled surface 51 merging into the wall 36. Also extending into the central opening are two shelves 52. The shelves define a slot 54 between them. The slot 54 communicates with a chamber 55 in which the actuator 16 is mounted. This chamber 55 is defined by a pair of posts 56 which extend in cantilevered fashion outwardly from the wall 36. The posts 56 have an angled outer surface 58, a curved roof surface 59 and are connected at their upper ends by a guide rail 60. The remaining element of the actuator mounting pocket or chamber is a retaining wall 62.

Details of the plunger 12 are shown in FIGS. 14–18. The plunger includes an outer, generally cylindrical skirt 64 and a central core 66, joined to the skirt by three spokes 68. A plurality of pegs 70 depend from the underside of the spokes 68. The skirt 64 has three vertical slots 72 in its surface. Disposed in the slots and depending from the top thereof are slender latch members 73 which terminate near the bottom of the skirt with a finger 74. Immediately below the fingers 74 there is a foot 76 having a heal 78. As shown in FIG. 14 the slots 72, latches 73, fingers 74, feet 76 and heel 78 cooperate with the hooks 42, slots 44, openings 46 and angled surfaces 48 of the housing to retain the plunger on the housing. Thus the plunger skirt 64 surrounds the upstanding wall 36 of the housing with the housing hooks 42 disposed in the slots 72 of the plunger while the fingers 74 are disposed in the slots 44 of the housing. The fingers 74 and hooks 42 engage to provide an upper limit to the plunger travel. Similarly the underside of spokes 68 and the top land of wall 36 cooperate to define the lower limit of plunger movement, with the openings 46 accommodating the heals 78 of the plunger skirt.

The core 66 of the plunger includes two depending walls 80 connected by an arcuate wall 82 at one end and a wall 84 at the other end. The wall 84 has a cut out portion which includes a ramp 86 (see also FIG. 2). At the bottom of the core walls 80 are a pair of outwardly projecting fingers 88. A shoulder 90 at the top of the core 66 forms a spring seat for the inner spring 18. A key cap could be attached at the opening 91. The plunger is preferably molded from thermoplastic polyester.

Turning now to FIGS. 9–13, the coupler 14 is shown in detail. The coupler has a cylindrical body portion 92 having four depending projections 94. The lower ends of the projections terminate at hooks 96. These hooks engage the underside of the housing ledges 50 to limit the upward movement of the coupler in the housing. Four tabs 98 are formed on top of the body portion 92 and they extend radially beyond the outer diameter of the body portion. The tabs 98 are spaced so as to coincide with the seats 40 on the top of the housing to limit downward movement when the coupler is placed in the housing. A pair of elongated coupler springs 100 are connected to the top of the body member 92 as best shown in FIG. 10. The springs are cantilevered toward the inside of the body portion. The resulting unsupported length of the springs 100 makes them inherently flexible. The coupler springs 100 terminate at inwardly projecting toes 102. A blocking tang 104 extends from the body portion outwardly and downwardly (see also FIG. 2). The coupler is made out of moldable polyester.

FIGS. 19 and 20 show the actuator 16. The actuator has a pivot shaft 106, a blocking lever 108, a reset lever 110 and a spring support 112. A heal 114 is formed on the underside of the actuator.

Returning now to the switch assembly of FIGS. 1 and 2, it will be noted that the core 66 of the plunger 12 fits inside the body portion 92 of the coupler. The skirt 64 of the plunger extends about the exterior of the upstanding wall portion 36 of the housing. The coupler 14 is reciprocal within the cylindrical wall of the housing, to the extent permitted by hooks 96 engaging the underside of ledges 50 and tabs 98 engaging seats 40. Outer spring 20 bottoms on the ledges 50 of the housing, surrounds the body 92 of the coupler and engages the underside of tabs 98. Inner spring 18 is disposed in the interior of the plunger core 66, against shoulder 90 and on the spring support 112 of the actuator 16. The actuator itself resides in the pocket formed by the slot 54 and cantilevered posts 56. When the switch is assembled, the actuator is inserted from the bottom of the housing and is guided into position by the curved roof surface 59. The actuator pivot shaft 106 rests on the housing base 32 adjacent retainer 62 and underneath the posts 56. The blocking tang 104 slides in a slot defined by the posts 56, and between the blocking lever 108 and reset lever 110 of the actuator.

Figure 21:
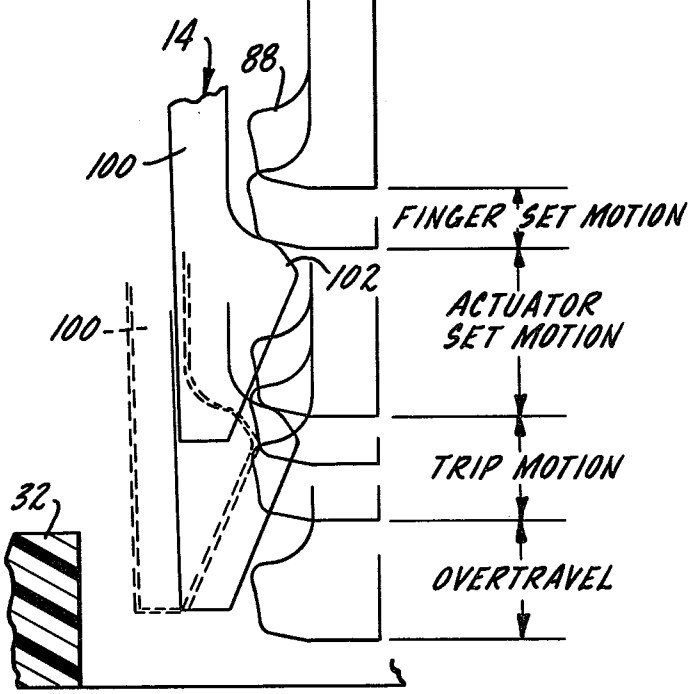
FIG. 21 is an enlarged detailed view showing a motion study of the coupler/plunger interface during break away of the coupling.

The use, operation and function of the switch are as follows. The plunger is movable through a closed-loop stroke which includes an initial rest position (shown in FIG. 2), a finger set motion, an actuator set motion, a trip motion, a switch closure point, an overtravel and a return. FIG. 21 shows the relationship of a plunger finger 88 and a toe 102 of a flexible coupler spring 100. When the plunger is in the rest position the finger 88 is above and spaced from the toe 102. As the plunger begins to move downwardly, the inner spring 18 is compressed and the finger 88 moves into contact with the toe 102. This is the finger set motion. When the fingers contact the toes, the actuator set motion begins. With the fingers 88 and toes 102 engaged, continued downward movement of the plunger causes the plunger and coupler to move as a unit. As the coupler 14 moves downwardly, the blocking tang 104 moves into engagement with the blocking lever 108. This prevents rotation of the actuator 16 about the pivot shaft 106. Thus even though the inner spring 18 is continuing to be compressed, the actuator is prevented from moving by the blocking tang. Continued movement of the engaged plunger-coupler combination brings the tabs 98 of the coupler into engagement with the seats 40 on the housing. Thus the coupler is prevented from further downward movement. This is where the trip motion begins since further downward movement of the plunger forces the plunger fingers 88 to flex the coupler springs 100 outwardly to the point where the toes 102 are disengaged from the fingers 88. When this disengagement occurs the outer spring 20 no longer resists the plunger downward movement. This sudden decrease in resistance provides a tactile feedback to the user. Also, disengagement of the coupler from the plunger allows the outer spring 20 to return the coupler to the fully raised position where the stops 50 are engaged by hooks 96. In this position the blocking tang no longer engages the blocking lever of the actuator, so the actuator is free to rotate about the pivot shaft 106. Since the inner spring 18 has been compressed all during the finger set, actuator set and trip motion of the plunger, its compression is suddenly released by disengagement of the blocking tang. This results in a sudden snapping of the actuator heel 114 against the membrane of the switch, thereby closing it. Thus there is simultaneous switch actuation and tactile feedback. Continued downward motion of the plunger after the switch closure point is referred to as overtravel. Overtravel brings the plunger pegs 70 into contact with the coupler 14 so that overtravel is eventually resisted by the outer spring 20. The plunger overtravel is resisted by the outer spring to cushion the lower stop of the plunger.

During the return portion of the plunger stroke the plunger is moved upwardly by the outer spring 20, at least until the coupler engages the stops 50. Then the return motion is due to the force of the inner spring 18 only. As the plunger moves upwardly, the reset lever 110 of the actuator 16 contacts the ramp surface 86, causing the actuator to rotate counterclockwise about the pivot shaft 106. This lifts the actuator heel 114 off of the membrane and resets the actuator for the next down-stroke of the plunger.

Figure 22:
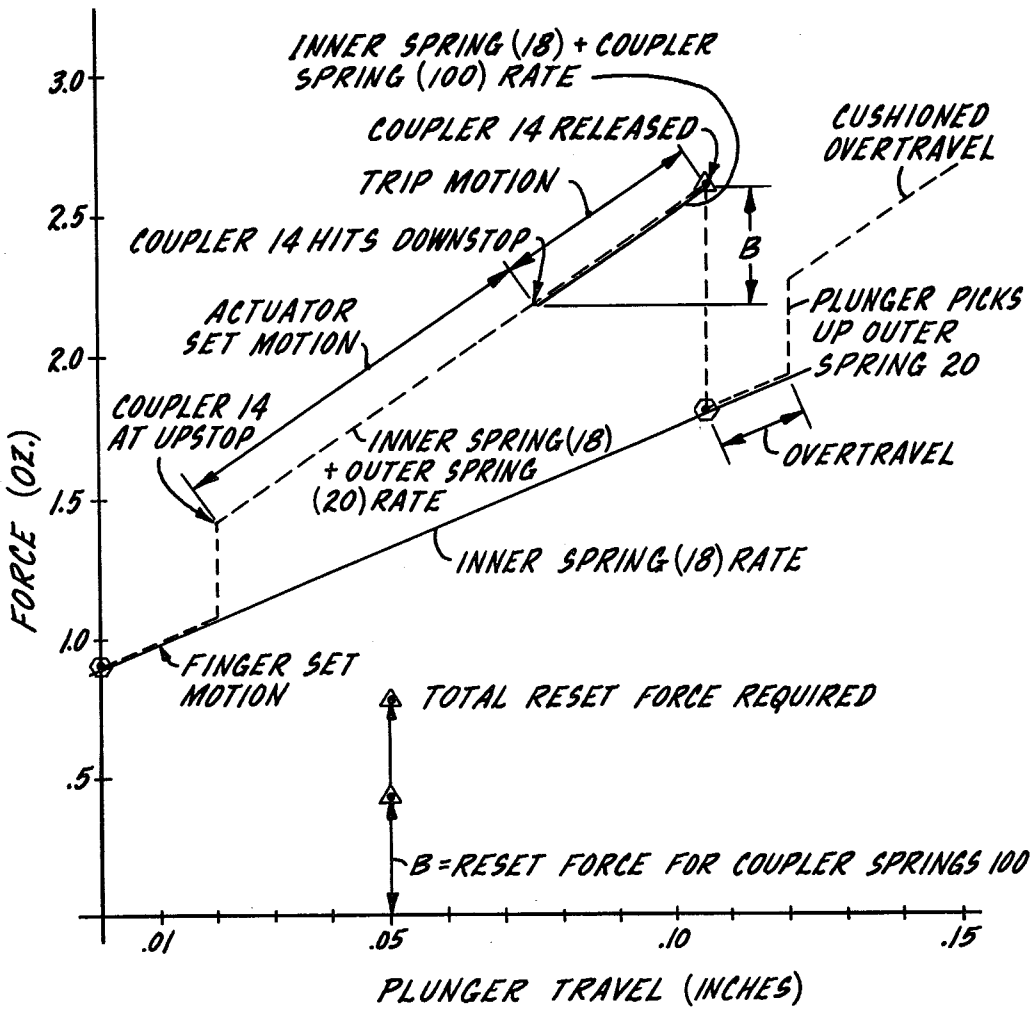
FIG. 22 is a force-travel graph showing the sequence of operations of the switch.

The switch operation is illustrated graphically in the force vs. travel graph of FIG. 22. The force shown by the dotted line on the graph is the upward force on the plunger exerted by the various springs. This upward force must be overcome by the switch user as he pushes the plunger down. In other words, the dotted line represents the resistance to downward motion of the plunger. When the plunger is at rest (i.e., travel equals zero) the inner spring 18 is somewhat compressed and therefore exerts a force on the plunger. At the onset of a plunger stroke, which begins with the finger set motion, only the inner spring comes into play so the dotted force curve follows the inner spring rate, as shown in FIG. 22. When the plunger has moved about 0.02 inches the plunger fingers 88 engage the coupler toes 102 and the plunger must thereafter carry the coupler with it. This brings the outer spring 20 into play, with the resultant step up in the force curve as the actuator set motion starts. Actuator set motion concludes at the point where the coupler hits the downstop. After this point the outer spring 20 can be depressed no further so it adds no more to the resisting force. But when the trip motion begins additional resistive force is created by the coupler springs 100. These springs are sized to have the same spring rate as the outer spring 20. So during the trip motion the force curve continues in a straight line. The additional force which the user must apply to overcome the coupler springs is indicated by the distance labeled "B". Now when the coupler is released neither the coupler springs 100 nor the outer spring 20 any longer resist the plunger. The force curves drops down to the level of the inner spring rate. This is the force drop that provides the tactile feedback; the user can feel the sudden drop in resistance to plunger motion. Of course, release of the coupler simultaneously disengages the blocking tang so switch actuation can occur. Overtravel is resisted at the inner spring rate until the plunger pegs 70 contact the coupler 14 which brings into play the outer spring at which time the rates are additive.

On the return stroke, sufficient reset force must be available to drive the plunger fingers back around the toes of the coupler springs. This is the force "B". Additional reset force is required to drive the ramp surface 86 past the actuator's return lever 110, thereby resetting the actuator. The total reset force required is shown on the graph. Since this is less than the force on the plunger at rest, it can be seen that sufficient reset force is available in the inner spring.

While a preferred form of the invention has been shown and described, it will be realized that modifications and alterations may be made thereto without departing from the scope of the following claims.

We claim:

1. A switch having tactile feedback, comprising:

a housing;

a set of electrical contacts associated with the housing;

a reciprocative plunger mounted in the housing and movable through a stroke including an initial rest position, an actuator set portion, a switch closure point, an overtravel portion and a return portion;

an actuator in the housing, operable to close the electrical contacts;

a first spring engaging the plunger and the actuator;

blocking means for isolating the actuator from the contacts, the blocking means being releasably connected to the plunger and activated thereby during the actuator set portion of the plunger stroke;

a second spring engageable between the housing and the blocking means, the plunger compressing the first spring and the second spring by virtue of the connection between the plunger and blocking means, during the actuator set portion of the stroke; and, means for disconnecting the plunger and blocking means, operative when the plunger stroke reaches the switch closure point, thereby releasing the compression of the second spring, the second spring then deactivating the blocking means so that the compression of the first spring acts upon the actuator which closes the contacts while the sudden decrease in the plunger resistance provides tactile feedback.

2. The switch of claim 1 wherein the blocking means comprises a blocking tang connected to a coupler, the coupler being carried by the plunger during the actuator set portion of the plunger stroke to a point where the blocking tang engages the actuator.

3. The switch of claim 2 wherein the second spring biases the coupler and blocking tang away from the actuator, and the means for disconnecting the plunger and blocking means is operative to separate the coupler from the plunger so the second spring will move the blocking tang out of engagement with the actuator, thereby allowing the actuator to close the switch.

4. The switch of claim 1 wherein the electrical contacts are in a membrane switch located under the housing.

5. The switch of claim 1 wherein the plunger engages the blocking means, and consequently the second spring, during overtravel so as to cushion the plunger prior to bottoming of the plunger on the housing.

6. A switch having tactile feedback, comprising a housing, a set of electrical contacts associated with the housing, a reciprocative plunger mounted in the housing, an actuator in the housing for closing the electrical contacts, a first spring located between the plunger and actuator biasing the plunger upwardly and the actuator downwardly, a reciprocative coupler in the housing, the coupler including a blocking tang and being engageable with the plunger during initial downward motion of the plunger, the blocking tang engaging the actuator during said initial downward plunger motion to prevent operation of the actuator, a second spring located between the coupler and the housing biasing the coupler upwardly, and means responsive to continued downward motion of the plunger for disengaging the coupler from the plunger, whereupon the second spring moves the coupler blocking tang out of engagement with the actuator which is then operated by the compressed first spring, the tactile feedback being created by the sudden decrease in plunger resistance due to disengagement of the coupler, and consequently the second spring, from the plunger.

7. The switch of claim 6 wherein the plunger engages the coupler, and consequently the second spring, a second time prior to bottoming on the housing so as to cushion the bottoming of the plunger on the housing.

8. The switch of claim 6 wherein the electrical contacts are in a membrane switch located under the housing.

* * * * *